US012025419B2

(12) United States Patent
Fisher

(10) Patent No.: US 12,025,419 B2
(45) Date of Patent: Jul. 2, 2024

(54) DUAL SHAFT ARROW AND INSERT

(71) Applicant: Mahana Fisher, Saint George, UT (US)

(72) Inventor: Mahana Fisher, Saint George, UT (US)

( * ) Notice: Subject to any disclaimer, the term of this patent is extended or adjusted under 35 U.S.C. 154(b) by 0 days.

(21) Appl. No.: 18/166,471

(22) Filed: Feb. 8, 2023

(65) Prior Publication Data

US 2023/0251066 A1 Aug. 10, 2023

Related U.S. Application Data

(60) Provisional application No. 63/307,970, filed on Feb. 8, 2022.

(51) Int. Cl.
*F42B 6/04* (2006.01)

(52) U.S. Cl.
CPC ..... *F42B 6/04* (2013.01)

(58) Field of Classification Search
CPC ..... F42B 6/04; F42B 6/06; F42B 6/08
See application file for complete search history.

(56) References Cited

U.S. PATENT DOCUMENTS

| | | | | |
|---|---|---|---|---|
| 3,759,519 | A * | 9/1973 | Palma | F42B 12/362 30/162 |
| 6,883,264 | B1 * | 4/2005 | Gimbel | A01K 81/04 43/6 |
| 8,337,342 | B1 * | 12/2012 | Huang | F42B 6/04 473/582 |
| 9,410,773 | B2 * | 8/2016 | Greenwood | F42B 6/08 |
| 9,982,974 | B1 * | 5/2018 | McGaha | F42B 6/04 |
| 2014/0256481 | A1 * | 9/2014 | Flint | F42B 6/04 473/578 |

* cited by examiner

*Primary Examiner* — John A Ricci
(74) *Attorney, Agent, or Firm* — Superior IP, PLLC; Dustin L. Call

(57) ABSTRACT

A dual shaft arrow insert. The dual shaft arrow insert includes a first portion, where the first portion is configured to attach to an inner surface of a terminal end of an inner shaft of a dual arrow system. The dual shaft arrow insert also includes a second portion. The second portion is attached to the first portion and includes an outer diameter which is larger than an outer diameter of the first portion. The dual shaft arrow insert further includes a collar. The collar is attached to the second portion opposite the first portion and includes a larger outer diameter than the outer diameter of the second portion. The dual shaft arrow insert additionally includes an attachment configured to allow for attachment of an arrowhead.

20 Claims, 3 Drawing Sheets

DUAL SHAFT ARROW AND INSERT

CROSS-REFERENCE TO RELATED APPLICATIONS

This application claims the benefit of and priority to U.S. Provisional patent application Ser. No. 63/307,970 filed on Feb. 8, 2022, which application is incorporated herein by reference in its entirety.

BACKGROUND OF THE INVENTION

Dual shaft arrows have been attempted before. The success of these dual shaft arrows depends greatly on the insert connecting the two shafts. There are inserts currently available that allow for components to be attached to the terminal end of an arrow shaft which is being used as a projectile accelerated by a bow. For example, a prior double shaft insert, U.S. Pat. No. 8,337,342 B, grant to inventor Huang December 2012, has been noted that allows a thin walled subtotal length internal shaft to assist the outer shaft of a double wall arrow system by being permanently attached by way of adhesives. This prior invention allows for a terminal portion of internal shaft varying from 15 to 65 percent of the main shaft length to assist in reducing oscillations and increase stiffness characteristics of an arrow shaft. The main proposed use of this prior patented arrow hybrid insert is to allow a secondary internal shaft of differing composition and thus different harmonics to reduce oscillations and improve flight characteristics.

Accordingly, there is a need in the art for a dual shaft arrow where the inner shaft acts independent of the outer shaft.

BRIEF SUMMARY OF SOME EXAMPLE EMBODIMENTS

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

One example embodiment includes a dual shaft arrow insert. The dual shaft arrow insert includes a first portion, where the first portion is configured to attach to an inner surface of a terminal end of an inner shaft of a dual arrow system. The dual shaft arrow insert also includes a second portion. The second portion is attached to the first portion, is configured to fit within an inner surface of a terminal end of an outer shaft of a dual arrow system and includes an outer diameter which is larger than an outer diameter of the first portion. The dual shaft arrow insert further includes a shoulder, where the shoulder is the transition between the first portion and the second portion, and a collar. The collar is attached to the second portion opposite the first portion and includes a larger outer diameter than the outer diameter of the second portion. The collar also includes a larger outer diameter than the inner surface of the terminal end of the outer shaft of a dual arrow system. The dual shaft arrow insert additionally includes an attachment. The attachment is interior to the collar, at least partially interior to the second portion and configured to allow for attachment of an arrowhead.

Another example embodiment includes a dual shaft arrow. The dual shaft arrow includes an outer shaft. The outer shaft includes a circular inner surface having an inner diameter and a circular outer surface having an outer diameter. The dual shaft arrow also includes an inner shaft, the inner shaft includes a circular inner cavity having an inner diameter and a circular outer surface having an outer diameter, where the outer diameter of the inner shaft is smaller than the inner diameter of the outer shaft. The dual shaft arrow further includes a dual shaft arrow insert. The dual shaft arrow insert includes a first portion, where the first portion is cylindrical and configured to attach to the inner surface of a terminal end of the inner shaft. The dual shaft arrow insert also includes a second portion. The second portion is cylindrical, attached to the first portion, and configured to fit within the inner surface of a terminal end of the outer shaft and includes an outer diameter which is larger than an outer diameter of the first portion. The dual shaft arrow insert further includes a shoulder, where the shoulder is the transition between the first portion and the second portion, and a collar. The collar is cylindrical and attached to the second portion opposite the first portion and includes a larger outer diameter than the outer diameter of the second portion. The collar also includes a larger outer diameter than the inner diameter of the outer shaft. The dual shaft arrow insert additionally includes a threaded tap. The threaded tap is at least partially interior to the second portion and configured to allow for attachment of an arrowhead.

Another example embodiment includes a dual shaft arrow. The dual shaft arrow includes an outer shaft. The outer shaft includes a circular inner surface having an inner diameter and a circular outer surface having an outer diameter. The dual shaft arrow also includes an inner shaft, the inner shaft includes a circular inner cavity having an inner diameter and a circular outer surface having an outer diameter, where the outer diameter of the inner shaft is smaller than the inner diameter of the outer shaft. The dual shaft arrow further includes a dual shaft arrow insert. The dual shaft arrow insert includes a first portion, where the first portion is cylindrical and configured to attach to the inner surface of a terminal end of the inner shaft. The dual shaft arrow insert also includes a second portion. The second portion is cylindrical, attached to the first portion, and configured to fit within the inner surface of a terminal end of the outer shaft and includes an outer diameter which is larger than an outer diameter of the first portion. The dual shaft arrow insert further includes a shoulder, where the shoulder is the transition between the first portion and the second portion, and a collar. The collar is cylindrical and attached to the second portion opposite the first portion and includes a larger outer diameter than the outer diameter of the second portion. The collar also includes a larger outer diameter than the inner diameter of the outer shaft. The dual shaft arrow insert additionally includes a threaded tap. The threaded tap is at least partially interior to the second portion and configured to allow for attachment of an arrowhead. The dual shaft arrow insert moreover includes a cavity. The cavity is interior to the collar and configured to receive a shank of the arrowhead. The dual shaft arrow also includes a nock adapter. The nock adapter is configured to attach to the outer shaft and receive a nock.

These and other objects and features of the present invention will become more fully apparent from the following description and appended claims or may be learned by the practice of the invention as set forth hereinafter.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Reference will now be made to the figures wherein like structures will be provided with like reference designations. It is understood that the figures are diagrammatic and schematic representations of some embodiments of the invention, and are not limiting of the present invention, nor are they necessarily drawn to scale.

Figure 1A:
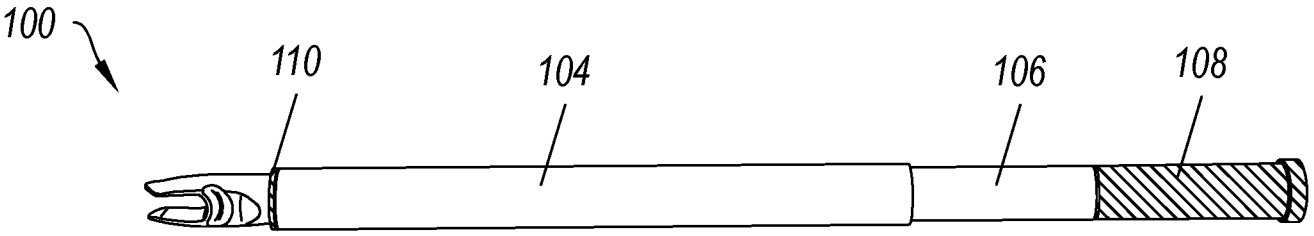
FIG. 1A illustrates an example of a dual shaft arrow.
Figure 1B:
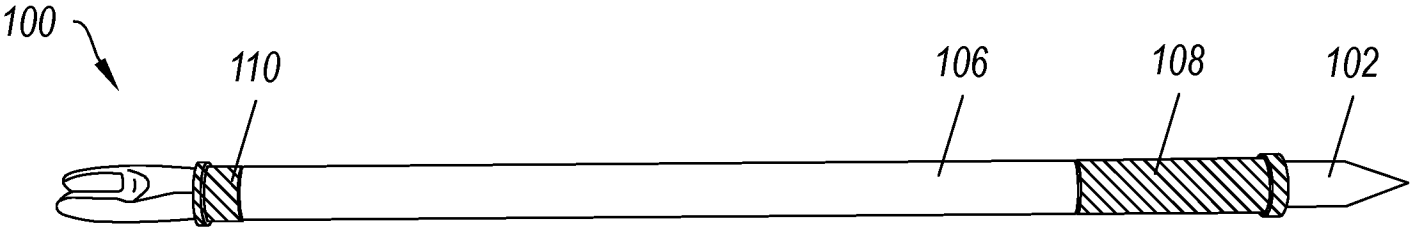
FIG. 1B illustrates the example of the dual shaft arrow of FIG. 1A with the outer shaft removed.

FIGS. 1A and 1B (collectively "FIG. 1") illustrate an example of a dual shaft arrow 100. FIG. 1A illustrates an example of the dual shaft arrow 100; and FIG. 1B illustrates the example of the dual shaft arrow 100 of FIG. 1A with the outer shaft removed. The dual shaft arrow 100 of FIG. 1 is shortened to allow for showing greater detail. The dual shaft arrow 100 has the benefit of being able to penetrate further than other arrows. In particular, as the dual shaft arrow 100 enters a target (whether live or inanimate) the arrowhead is configured to penetrate the target. However, because of how materials naturally react, the hole created by the arrowhead attempts to close around the penetrating shaft. This causes friction on the outside of the shaft, slowing down the arrow and limiting the penetration depth. The dual shaft arrow 100 can "telescope" when this occurs, allowing a portion of the dual shaft arrow 100 to continue moving into the target at a deeper penetration depth.

As used in the specification and the claims, the phrase "configured to" denotes an actual state of configuration that fundamentally ties recited elements to the physical characteristics of the recited structure. That is, the phrase "configured to" denotes that the element is structurally capable of performing the cited element but need not necessarily be doing so at any given time. Thus, the phrase "configured to" reaches well beyond merely describing functional language or intended use since the phrase actively recites an actual state of configuration.

An arrow is a fin-stabilized projectile launched by a bow. A typical arrow usually consists of a long, stiff, straight shaft with a weighty (and usually sharp and pointed) arrowhead attached to the front end, multiple fin-like stabilizers called fletchings mounted near the rear, and a slot at the rear end called nock for engaging the bowstring. The fletchings are not shown herein for simplicity.

FIG. 1 shows that the dual shaft arrow 100 can include an arrowhead 102. An arrowhead or point is the usually sharpened and hardened tip of an arrow, which can contribute a majority (greater than 50%) of the arrow's mass and is responsible for impacting and penetrating a target, as well as to fulfill some special purposes such as signaling. Arrowheads 102 can be designed to easily penetrate a target, reducing the amount of drag, but the shaft is typically not designed to reduce drag. Arrowheads 102 are typically removable. That is, the arrowhead 102 can be unscrewed from the arrow shaft and replaced with another arrowhead 102.

FIG. 1 shows that the dual shaft arrow 100 includes an outer shaft 104. The outer shaft 104 is what would look like the shaft of a normal arrow. I.e., it is the exterior of the shaft and can be handled by the user. This includes letting the user pick up the arrow, nock the arrow and launch the arrow from a bow. The outer shaft 104 has a circular outer surface and circular hollow interior defined by an interior surface. The outer shaft 104 can be made of any desired material, such as fiberglass, wood, carbon fiber or any other desired material.

FIG. 1 also shows that the dual shaft arrow 100 includes an inner shaft 106. The inner shaft 106 has a circular outer surface with a diameter that is smaller than the inner diameter of the outer shaft 104. This allows the inner shaft 106 to be placed in the interior of the outer shaft 104. The arrowhead is attached to the inner shaft 106. When the outer shaft 104 binds on the target, the inner shaft continues forward, increasing the penetration depth of the arrowhead. That is, the outer shaft 104 because a low friction conduit through which the inner shaft 106 can pass, increasing penetration distance. The inner shaft 106 can be made of any desired material, such as fiberglass, wood, aluminum, or carbon. In general, the inner shaft 106 will be the same material as the outer shaft 104, but this is not a requirement.

FIG. 2 moreover shows that the dual shaft arrow 100 can include an insert 108. The insert 108 is made up of steel, aluminum, or other metallic material, carbon, polycarbonate, other plastic materials or any other desired materials. The dual shaft insert 108 is used for indexing and centering two shafts concentrically with each other while allowing freedom of translational movement when encountering resistance. In other words, the dual shaft insert 108 keeps the inner shaft 106 centered within the outer shaft 104 while still allowing the inner shaft 106 to exit the outer shaft 104 when the outer shaft 104 binds in the target.

FIG. 2 also shows that the dual shaft arrow 100 can include a nock adapter 110. The nock adapter 110 allows a nock to be attached to the outer shaft 104. The nock adapter 110 also centers the rear (away from the arrowhead) of the inner shaft so that during flight the rear of the inner shaft remains centered within the outer shaft 106.

Figure 2A:
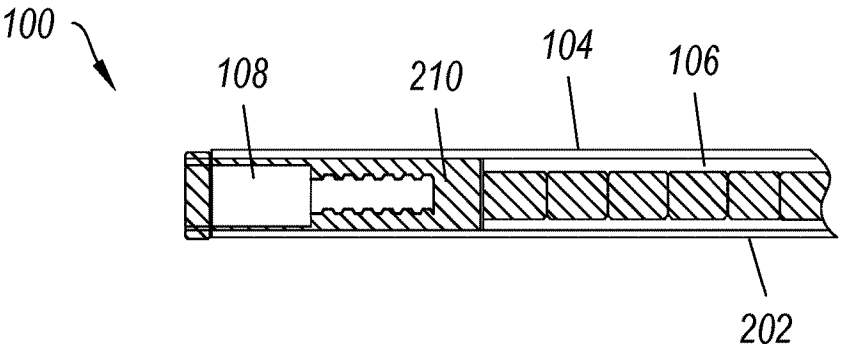
FIG. 2A illustrates a cutaway view of the terminal end of the dual shaft arrow.
Figure 2B:
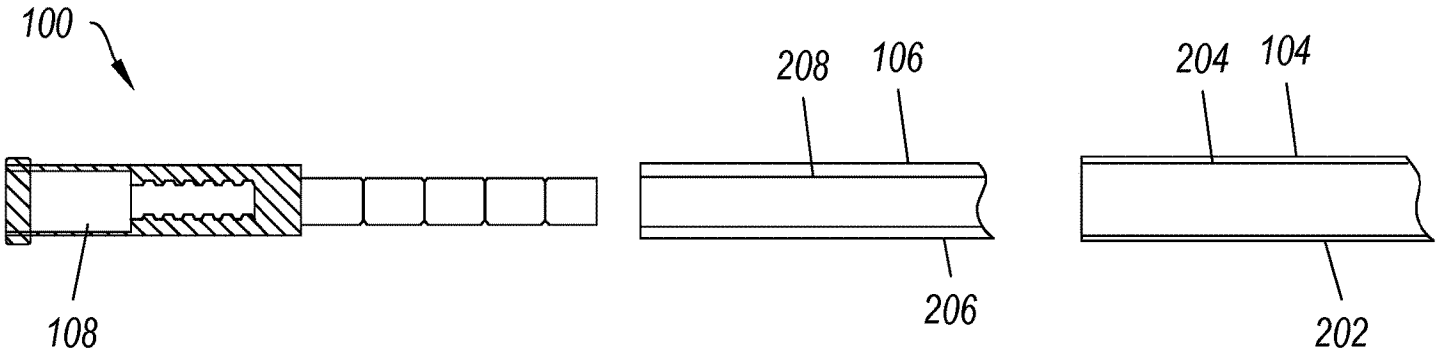
FIG. 2B illustrates an exploded view of the cutaway view of the dual shaft arrow.

FIGS. 2A and 2B (collectively "FIG. 2") illustrate a cutaway view of the terminal end of a dual shaft arrow 100. FIG. 2A illustrates a cutaway view of the terminal end of the dual shaft arrow; and FIG. 2B illustrates an exploded view of the cutaway view of the dual shaft arrow 100. A The dual shaft arrow 100 has greater penetration than a single shaft arrow. The inner shaft 106 telescopes from the outer shaft 104, increasing penetration distance of the arrowhead. During flight, the inner shaft 104 needs to be centered within the outer shaft 106 or the inner shaft can cause wobbling of the arrow, decreasing accuracy.

FIG. 2 shows that the outer shaft 104 includes an outer surface 202. The outer surface 202 is the portion of the outer shaft 104 which will encounter friction when entering the target. Thus, the outer surface 202 should be as smooth and straight as possible to minimize the resistance when entering the target. The diameter of the outer surface 202 is generally between 6.5 and 9 millimeters. For example, the diameter of the outer surface 202 can be approximately 7.5 millimeters. As used in the specification and the claims, the term approximate shall mean that the value is within 10% of the stated value, unless otherwise specified.

FIG. 2 also shows that the outer shaft 104 can include an inner surface 204. The inner surface 204 creates a friction free (or low friction) cavity for the inner shaft 106 to pass through as the outer surface 202 encounters friction from entering a target. Thus, the inner surface 204 should be as smooth and straight as possible to allow the inner shaft 106 to easily exit the outer shaft 104. The diameter of the inner surface 204 is generally between 4 and 7 millimeters. For example, the diameter of the inner surface 204 can be approximately 6.2 millimeters.

FIG. 2 further shows that the inner shaft 104 can include an outer surface 206. The outer surface 206 of the inner shaft 104 has a diameter which is smaller than the diameter of the inner surface 202 of the outer shaft 104. The outer surface 206 is the portion of the inner shaft 104 which will possibly encounter friction when exiting the outer shaft 104 and/or entering the target. Thus, the outer surface 206 should be as smooth and straight as possible to minimize the resistance when entering the target. Because the outer diameter of the outer surface 206 of the inner shaft 106 is smaller than the outer diameter of the outer surface 202 of the outer shaft 104, the friction between the outer surface 206 of the inner shaft 106 and the target is minimized, increasing penetration depth. The diameter of the outer surface 206 is generally between 3.95 and 6.95 millimeters. For example, the diameter of the outer surface 206 can be approximately 6.15 millimeters.

The size difference between the outer shaft 104 and the inner shaft 106 is critical for the proper operation of the dual shaft arrow 100. If the diameter of the outer surface of the inner shaft 106 is too close to the diameter of the inner surface of the outer shaft 104, then the inner shaft will experience friction as it exits the outer shaft 104. Likewise, if the size the diameter of the outer surface of the inner shaft 106 is too small relative to the diameter of the inner surface 204 of the outer shaft 104 then the inner shaft 106 can wobble as it exits the outer shaft 104. I.e., it is critical that the inner shaft 106 not "rub" the outer shaft 104 while telescoping. Therefore, the diameter of the outer surface 206 should be between 95% and 99.7% of diameter of the inner surface 204. For example, the diameter of the outer surface 206 should be approximately 99% of the diameter of the inner surface 204. Experimentation has shown that an inner shaft with an outer diameter of 0.3% less the inner diameter of the outer shaft provides flight characteristic similar to that of a solid shaft and allow the inner shaft to slide within the out shaft with minimal friction between the inner and outer shafts.

FIG. 2 additionally shows that the inner shaft 104 can include an inner surface 208. The inner surface 208 can traverse the entire length of the inner shaft 104 or can only be a portion of the inner shaft 104. I.e., the inner shaft 104 can be a solid shaft with only a portion hollowed out (to allow attachment of other components, as discussed below) or can be completely hollow. Hollow inner shafts 104 create a lighter shaft, which may or may not be beneficial, depending on the intended use. The inner shaft 104 can be one of many different diameters and weights that are better for heavier or lighter draw bows. Lighter inner shafts 104 fly flatter and faster but lack the impact power and penetration of a heavier inner shaft 104.

Figure 3:
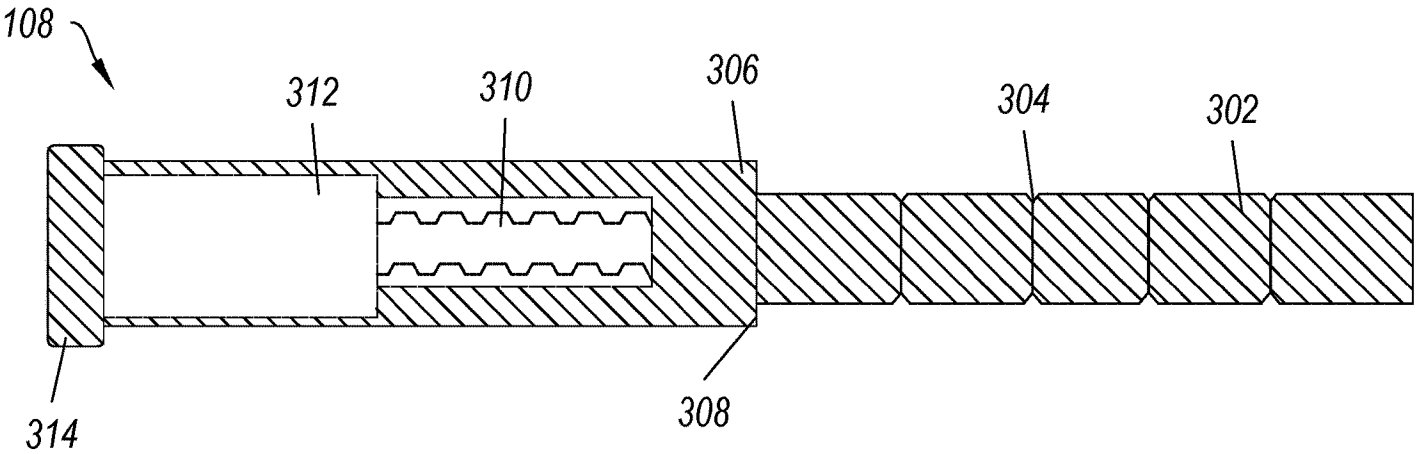
FIG. 3 is a zoomed in view of the dual shaft arrow insert.

FIG. 3 is a zoomed in view of the insert 108. The insert 108 creates a slight friction for holding the insert 108 and attached inner shaft within the outer shaft and holds it concentric along the longitudinal axis of both shafts. The insert 108 is also used for aligning the broadhead or point tip concentrically and in line with the longitudinal axis of the shaft or shafts. I.e., the arrowhead is attached to the insert 108, centering it on both the inner shaft and the outer shaft.

There is a lack of inserts in the archery industry which allow two shafts of differing diameters to function as a single arrow shaft. There is an absence of very stiff arrow shafts that allow the use of heavy points, such as broadheads and field points, with heavy draw weight bows. The advent of micro diameter carbon fiber arrow shafts, with an inner diameter of 3.0-5.2 mm has created a need for a solid shaft micro diameter insert 108 that transitions to a traditional hollow-threaded insert 108. The dual shaft insert 108 then allows the use of traditional-diameter arrow shafts to be combined with the micro diameter shaft in a dual wall arrow system. There is also an absence of a dual arrow shaft system that allows the micro-diameter arrow shaft with associated tip to separate from the larger traditional shaft arrow, and its associate components such as fletchings, nocks, and bushings. The separation of the dual arrow shaft system into its micro diameter shaft and traditional diameter arrow shaft reduces friction of the tip and micro diameter shaft and thus increases penetration of the arrow into an object. The dual shaft insert 108 is the component which permanently affixes the inner micro diameter arrow shaft to the arrow point and allows the micro-diameter shaft to act as an independent arrow. This independent arrow without the drag of the external shaft and attached components, such as fletching and nock, continues in the vector path of momentum with the point of the arrow directed in the line of trajectory.

Whereas prior hybrid arrow inserts create a double walled single arrow system, the proposed dual shaft insert 108 can attach permanently via adhesives to a full length independently acting inner shaft that is non permanently attached to the outer shaft. The advantage of the dual shaft insert 108 is that it allows two complete shafts to separate into two independently acting inner and outer shafts when resistance of the outer shaft is encountered with the inner shaft continuing as a functioning arrow complete with distally attached components, insert 108, and full-length shaft.

The insert 108 can be made of any desired materials. For example, the insert can include aluminum, brass, steel, carbon fiber, and polycarbonate materials. The insert can be sized to accommodate different shafts and can be weighted to create the desired length and mass. The dual shaft insert is created using several manufacturing techniques including CNC lathe-turned machine, metal injection molding with machining to specification, mold forming or any other desired manufacturing techniques.

FIG. 3 shows that the insert 108 includes a first portion 302. The first portion 302 attaches to the inner surface of the inner shaft. That is, the outer diameter of the first portion 302 is very close to the same as the diameter of the inner surface of the inner shaft. Therefore, the outer diameter of the first portion 302 would be between 99% and 100% of the diameter of the inner surface of the inner shaft. For example, the outer diameter of the first portion should be approximately 99.5% of the diameter of the inner surface of the inner shaft. Experimentation has shown that the diameter of the inner shaft must be near compression fitting of the inner diameter of the shaft to align the insert and minimize linear deviation. Furthermore experimentation has shown the thinner the layer of adhesive attaching the outer diameter of the first portion 302 to the diameter of the inner surface of the inner shaft the stronger the bond will be. This securely attaches the insert 108 to the terminal end (the end where the arrowhead attaches) of the inner shaft.

FIG. 3 also shows that the insert 108 can include one or more glue grooves 304 on the first portion 302. The one or more glue grooves allows for permanent attachment between the insert 108 and the inner shaft. In particular, because the first portion 302 has an outer diameter which is very close to the inner diameter of the inner shaft there is a friction fit. However, for a permanent attachment, any glue placed on the first portion would be pushed off because of the tightness of the fit. The one or more glue grooves 304 give an area where glue can remain during insertion and remain during curing.

FIG. 3 further shows that the insert 108 can include a second portion 306. The second portion 206 fits within, but does not attach to, the outer shaft. The outer diameter of the second portion should be close to the inner diameter of the outer shaft, (which will make it equal to or greater than the outer diameter of the inner shaft) but it should not be overly tight, otherwise it will prevent the inner shaft from exiting the outer shaft during use. I.e., if the friction between the second portion 306 and the outer shaft is too high because of the tightness of fit, then the dual shaft arrow will not telescope as it should. Therefore, the diameter of the second portion 306 should be between 99.7% and 100% of the diameter of the inner surface of the outer shaft. For example, the diameter of the second portion 306 can be approximately 99.9% of the diameter of the inner surface of the outer shaft. Experimentation has shown the second portion 306 with an outer diameter of 0.1% to 0% of the inner diameter of the outer shaft provides alignment with minimal resistance while still allowing to separate. This allows the insert 108 to connect the two shafts together concentrically at the insert 108 or terminal end (arrowhead end) of the outer and inner arrow shafts. Thus, the two shafts function as a single bonded shaft or as two separate concentrically aligned telescoping shafts.

FIG. 3 additionally shows that the insert 108 can include a shoulder 308. The shoulder 308 is a product of the different diameters between the first portion 302 and the second portion 306. The shoulder 308 makes it easy for the first portion 302 to be inserted the correct depth into the inner shaft. I.e., the shoulder 308 fits tight against the terminal end of the inner shaft.

FIG. 3 moreover shows that the insert 108 can include a thread tap 310 what allows for attachment of an arrowhead. The thread tap 310 conforms to the Archery Manufacturers and Merchants Organization ("AMO") standard (this standard can be viewed at http://peteward.com/AMOStandards.pdf, which is incorporated by reference herein in its entirety) and have AMO standard 8-32 internal threads with bore depth for standard screw-in heads and points to be used. Thus, standard arrowheads can be purchased and attached to the insert 108 with the threading entering being located in the second portion 306.

FIG. 3 also shows that the insert 108 can include a cavity 312. The cavity 312 can be a space where the shank of the arrowhead (the portion of the arrowhead that the threads are attached to) can reside. I.e., as the threads of an arrowhead are screwed into the thread tap 310, the shank resides within the cavity 312, which centers and supports the arrowhead after attachment. The size of the cavity 312 is likewise matched to the above AMO standards.

FIG. 3 further shows that the insert 108 can include a collar 314. The collar 314 has a larger diameter than the inside diameter of the outer shaft (and will usually be approximately equal to the outer diameter of the outer shaft). This helps a user to gauge the depth of insertion of the inner shaft within the outer shaft. In other words, the outer diameter of the collar 314 is larger than the diameter of second portion 306 to prevent over insertion of the inner shaft into the outer shaft and to allow a user to see whether the inner shaft is fully inserted into the outer shaft.

Figure 4:
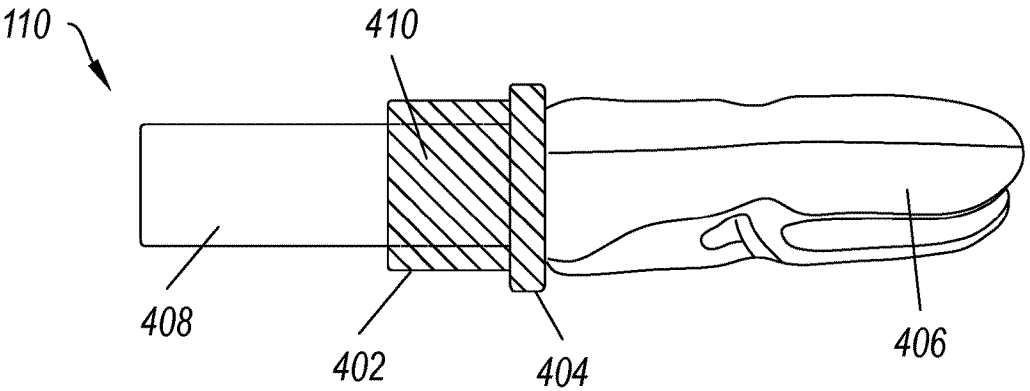
FIG. 4 is a zoomed in view of the nock adapter.

FIG. 4 is a zoomed in view of the nock adapter 110. The nock adapter 110 allows for attachment of a nock, according to the user's preferences. Likewise, the nock adapter assures that the inner shaft is aligned concentrically within the outer shaft at the nock end of the arrow. Thus, when the nock adapter 110 and insert of FIG. 3 are used in conjunction with one another, both ends of the inner shaft are aligned for optimal use.

FIG. 4 shows that the nock adapter 110 can include a sleeve 402. The sleeve 402 is inserted into the outer shaft. I.e., the outer diameter of the sleeve 402 is approximately equal to the inside diameter of the outer shaft, allowing the sleeve to be friction fit within the outer shaft.

FIG. 4 also shows that the nock adapter 110 can include a collar 404. The collar 404 prevents the nock adapter 110 from being over inserted into the outer shaft. I.e., the collar 314 has a larger diameter than the inside diameter of the outer shaft (and will usually be approximately equal to the outer diameter of the outer shaft). This helps a user to gauge the depth of insertion of the nock adapter 110 within the outer shaft. In other words, the outer diameter of the collar 314 is larger than the diameter of the inner surface of the outer shaft to prevent over insertion of the nock adapter 110 into the outer shaft and to allow a user to see whether the nock adapter 110 is fully inserted into the outer shaft.

By way of example, FIG. 4 shows a nock 406 within the nock adapter 110. The arrow nock 406 is a small notch at the back end of the arrow. The nock 406 connects the arrow to the bowstring and has many different purposes. Additionally, the nock 406 keeps the arrow oriented in the right direction. Arrow nock 406 also keeps the arrow from sliding sideways during the shooting process and maximizes an arrow's energy. While arrow nock 406 keeps the arrow attached to the string and centered, upon release it transfers all of the energy from the bow, into the arrow.

A press-fit nock 406 is shown as exemplary herein. However, there are other types of nocks which can be used with the dual shaft arrow. Some of the more popular types of arrow nocks include press-fit nocks, pin nocks, over-nocks, conventional nocks and lighted nocks. Nocks are sized according to bow string size and press-fit nocks and over nocks are additionally sized based on the size of the shaft they are used with.

The nock 406 includes a shank 408 that is inserted into an arrow shaft in a friction fit manner. I.e., the outer diameter of the shank 408 is approximately equal to the diameter of the inner shaft. This allows the inner shaft to be concentrically aligned within the outer shaft by the combination of the nock 406 and the dual shaft insert.

FIG. 4 further shows that the nock adapter 110 can include a channel 410. The channel 410 allows the shank 408 to pass through the nock adapter 110 where it is then press fit within the inner shaft. Because the inner shaft should telescope from the outer shaft, the shank 408 is not pressed completely into the inner shaft. I.e., the channel 410 passes through the sleeve 402 and the collar 406. The shank 408 aligns the inner shaft concentrically within the outer shaft, but when the outer shaft encounters friction from entering a target, the resistance allows the inner shaft to be disconnected from the shank 408 while the inner shaft further penetrates the target.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A dual shaft arrow insert, the dual shaft arrow insert comprising:
- a first portion, wherein the first portion is configured to attach to an inner surface of a terminal end of an inner shaft of a dual arrow system;
- a second portion, wherein the second portion:
  - is attached to the first portion;
  - is configured to fit within an inner surface of a terminal end of an outer shaft of a dual arrow system; and
  - includes an outer diameter which is larger than an outer diameter of the first portion;
- a shoulder, wherein the shoulder is the transition between the first portion and the second portion;
- a collar, wherein the collar:
  - is attached to the second portion opposite the first portion;
  - includes a larger outer diameter than the outer diameter of the second portion; and
  - includes a larger outer diameter than the inner surface of the terminal end of the outer shaft of a dual arrow system; and
- an attachment, wherein the attachment is:
  - interior to the collar;
  - at least partially interior to the second portion; and
  - configured to allow for attachment of an arrowhead.

2. The dual shaft arrow insert of claim 1, wherein the first portion includes one or more glue grooves.

3. The dual shaft arrow insert of claim 1 wherein the attachment is configured to receive at least a portion of the arrowhead.

4. The dual shaft arrow insert of claim 3 further comprising:
- a cavity, wherein the cavity is:
  - interior to the collar; and
  - configured to receive a shank of the arrowhead.

5. The dual shaft arrow insert of claim 3 wherein the attachment includes:
- a thread tap, wherein the threaded tap is configured to receive the threads of an arrowhead.

6. A dual shaft arrow, the dual shaft arrow comprising:
- an outer shaft, the outer shaft including:
  - a circular inner surface having an inner diameter; and
  - a circular outer surface having an outer diameter;
- an inner shaft, the inner shaft including:
  - a circular inner cavity having an inner diameter; and
  - a circular outer surface having an outer diameter, wherein the outer diameter of the inner shaft is smaller than the inner diameter of the outer shaft; and
- a dual shaft arrow insert, the dual shaft arrow insert comprising:
  - a first portion, wherein the first portion is:
    - cylindrical;
    - configured to attach to the inner surface of a terminal end of the inner shaft;
  - a second portion, wherein the second portion:
    - is cylindrical;
    - is attached to the first portion;
    - is configured to fit within the inner surface of a terminal end of the outer shaft; and
    - includes an outer diameter which is larger than an outer diameter of the first portion;
  - a shoulder, wherein the shoulder is the transition between the first portion and the second portion;
  - a collar, wherein the collar:
    - is cylindrical;
    - is attached to the second portion opposite the first portion; and
    - includes a larger outer diameter than the outer diameter of the second portion; and
    - includes a larger outer diameter than the inner diameter of the outer shaft; and
  - a threaded tap, wherein the threaded tap is:
    - at least partially interior to the second portion; and
    - configured to allow for attachment of an arrowhead.

7. The dual shaft arrow of claim 6 wherein the outside diameter of the second portion is approximately equal to the inner diameter of the outer shaft.

8. The dual shaft arrow of claim 6 wherein the outside diameter of the collar is approximately equal to the outer diameter of the outer shaft.

9. The dual shaft arrow of claim 6 wherein the inner surface of the outer shaft is a low friction surface.

10. The dual shaft arrow of claim 6 wherein the outer surface of the inner shaft is a low friction surface.

11. The dual shaft arrow of claim 6 wherein the outer diameter of the inner shaft is between 95% and 99.7% of the inner diameter of the outer shaft.

12. The dual shaft arrow of claim 6 wherein the outer diameter of the inner shaft is approximately 99% of the inner diameter of the outer shaft.

13. A dual shaft arrow, the dual shaft arrow comprising:
- an outer shaft, the outer shaft including:
  - a circular inner surface having an inner diameter; and
  - a circular outer surface having an outer diameter;
- an inner shaft, the inner shaft including:
  - a circular inner cavity having an inner diameter; and
  - a circular outer surface having an outer diameter, wherein the outer diameter is smaller than the inner diameter of the outer shaft; and
- a dual shaft insert, the dual shaft insert comprising:
  - a first portion, wherein the first portion is:
    - cylindrical;
    - configured to attach to the inner surface of a terminal end of the inner shaft;
  - a second portion, wherein the second portion:
    - is cylindrical;
    - is attached to the first portion;
    - is configured to fit within the inner surface of a terminal end of the outer shaft; and
    - includes an outer diameter which is larger than an outer diameter of the first portion;
  - a shoulder, wherein the shoulder is the transition between the first portion and the second portion;
  - a collar, wherein the collar:
    - is cylindrical;
    - is attached to the second portion opposite the first portion; and
    - includes a larger outer diameter than the outer diameter of the second portion; and
    - includes a larger outer diameter than the inner diameter of the outer shaft;
  - a threaded tap, wherein the threaded tap is:
    - at least partially interior to the second portion; and
    - configured to allow for attachment of an arrowhead;
  - a cavity, wherein the cavity is:
    - interior to the collar; and configured to receive a shank of the arrowhead; and a nock adapter, wherein the nock adapter is configured to:

attach to the outer shaft; and receive a nock.

14. The dual shaft arrow of claim 13, wherein the nock adapter includes:

a sleeve, wherein the sleeve is:

is cylindrical;

includes an outer diameter, wherein the outer diameter is smaller than the inner diameter of the outer shaft;

configured to fit within the inner surface of a nock end of the outer shaft.

15. The dual shaft arrow of claim 14, wherein the nock adapter includes:

a collar, wherein the collar:

is cylindrical;

is attached to the sleeve; and includes an outer diameter, wherein the outer diameter is larger than the outer diameter of the sleeve.

16. The dual shaft arrow of claim 15, wherein the nock adapter includes:

a channel, wherein the channel:

is cylindrical;

includes an inner diameter;

passes through the sleeve of the nock adapter and the collar of the nock adapter; and is configured to receive a shank of a nock.

17. The dual shaft arrow of claim 16 wherein the inner diameter of the channel is approximately equal to the inner diameter of the inner shaft.

18. The dual shaft arrow of claim 16 wherein the outside diameter of the collar of the nock adapter is approximately equal to the outer diameter of the outer shaft.

19. The dual shaft arrow of claim 16 wherein the diameter of the first portion is between 99.7% and 100% of the diameter of the inner surface of the inner shaft.

20. The dual shaft arrow of claim 19 wherein the diameter of the first portion is approximately 99.9% of the diameter of the inner surface of the inner shaft.

* * * * *